US008886078B2

(12) United States Patent
Ohno et al.

(10) Patent No.: US 8,886,078 B2
(45) Date of Patent: Nov. 11, 2014

(54) IMAGE FORMING APPARATUS

(75) Inventors: Yoshinori Ohno, Toyokawa (JP); Mitsuru Satou, Toyokawa (JP)

(73) Assignee: Konica Minolta Business Technologies, Inc., Chiyoda, Tokyo (JP)

( * ) Notice: Subject to any disclaimer, the term of this patent is extended or adjusted under 35 U.S.C. 154(b) by 249 days.

(21) Appl. No.: 13/399,573

(22) Filed: Feb. 17, 2012

(65) Prior Publication Data

US 2012/0213545 A1 Aug. 23, 2012

(30) Foreign Application Priority Data

Feb. 21, 2011 (JP) ..... 2011-034414

(51) Int. Cl.
*G03G 21/20* (2006.01)
*G03G 15/01* (2006.01)

(52) U.S. Cl.
CPC ..... *G03G 15/0189* (2013.01); *G03G 21/206* (2013.01); *G03G 2215/0132* (2013.01)
USPC ..... 399/92; 399/94; 399/21

(58) Field of Classification Search
None
See application file for complete search history.

(56) References Cited

U.S. PATENT DOCUMENTS

| | | | | |
|---|---|---|---|---|
| 7,526,223 | B2 | 4/2009 | Adachi et al. | |
| 7,769,329 | B2 | 8/2010 | Shimura et al. | |
| 7,941,069 | B2 | 5/2011 | Idehara et al. | |
| 2010/0158557 | A1 * | 6/2010 | Kuroda et al. | 399/92 |

FOREIGN PATENT DOCUMENTS

| | | | |
|---|---|---|---|
| JP | 2002-116598 | A | 4/2002 |
| JP | 2003-241591 | A | 8/2003 |
| JP | 2005-091674 | A | 4/2005 |
| JP | 2006-337589 | A | 12/2006 |
| JP | 2007-114597 | A | 5/2007 |
| JP | 2008-096944 | A | 4/2008 |
| JP | 2008-170853 | A | 7/2008 |
| JP | 2010-002711 | A | 1/2010 |
| JP | 2010-151882 | A | 7/2010 |

OTHER PUBLICATIONS

Office Action (Notification of Reasons for Refusal) dated May 7, 2013, issued in corresponding Japanese Patent Application No. 2011-034414, and an English Translation of the Office Action. (6 pages).

* cited by examiner

*Primary Examiner* — Walter L Lindsay, Jr.
*Assistant Examiner* — Roy Y Yi
(74) *Attorney, Agent, or Firm* — Buchanan Ingersoll & Rooney PC

(57) ABSTRACT

An intake fan (62) is provided on a side surface of an exposure device (40) provided below a plurality of image formation portions (20) far from a fixing unit (30), and a ventilation path (70) is formed on a side surface of the exposure device (40) on a back side, and outside air sucked by the intake fan (62) into a body of an apparatus is fed through the ventilation path (70) to the back side of the image formation portion (20K) closest to the fixing unit (30). The air flows through a space between a division plate (80) and the image formation portions (20) toward a discharge fan (61), and the image formation portions (20) are air-cooled sequentially from the image formation portion (20K). Thus, it is possible to effectively air-cool the image formation portions without increasing the size of the apparatus.

9 Claims, 6 Drawing Sheets

IMAGE FORMING APPARATUS

This application is based on Japanese Patent Application No. 2011-34414 filed on Feb. 21, 2011, the contents of which are hereby incorporated by reference.

BACKGROUND OF THE INVENTION

1. Field of the Invention

The present invention relates to an image forming apparatus such as an electrophotographic printer, copying machine or facsimile, and more particularly to an image forming apparatus incorporating a unit for cooling an image formation portion.

2. Description of the Related Art

In an electrophotographic image forming apparatus, as its functions such as double-sided printing are enhanced and the resolution in image quality is increased, the speed of formation of an image is increased. Hence, in the device, not only a heating source for a fixing device but also a large number of heating components such as power supplies for drive components such as a motor or a solenoid and for control operations are used. Moreover, since the size of the device is reduced, a large number of complicated components are more densely mounted. Thus, heat is easily left in the device, and the temperature within the device is easily increased. When the temperature within the device is increased, it is likely that toner within a development device is melted and solidified and thus the quality of an image is reduced.

Hence, for example, Japanese Unexamined Patent Application Publication No. 2010-2711 proposes a technology in which a cooling duct is divided into two portions, one cooling duct preferentially cools a process cartridge closest to a heating fixing unit, the other cooling duct cools a process cartridge left by further diving the process cartridge, the temperature difference between the process cartridges is reduced and the entire device is efficiently cooled.

However, in the proposed technology, it is necessary to provide a plurality of cooling ducts and a large blower, and hence the size of the device may be increased. Moreover, in the proposed technology, consideration is not given to the heating of a drive portion for driving the process cartridges. Drive sources such as motors that rotate the photoconductive member of the process cartridge and a development device and a drive transmission mechanism also generate a large amount of heat; it is therefore desirable to provide a cooling structure with consideration given to the heat from these drive sources and the like.

In view of the foregoing conventional problem, the present invention is made; an object of the present invention is to efficiently cool a plurality of image formation portions of an image forming apparatus without the size of the device being increased.

SUMMARY OF THE INVENTION

To achieve the above object, according to the present invention, there is provided an image forming apparatus including: a plurality of image formation portions that include: a rotatable electrostatic latent image carrying member; a charging unit which uniformly charges a surface of the electrostatic latent image carrying member; and a development unit which visualizes, with toner, an latent image formed on the electrostatic latent image carrying member and that forms toner images of different colors; a transfer unit that transfers the toner images formed and superimposed by the image formation portions to a transfer-receiving member; a fixing unit that heats the transferred toner images to melt and fix the toner images to the transfer-receiving member; and a blower unit that forms an airflow moving from an image formation portion closest to the fixing unit to an image formation portion farthest from the fixing unit, in which the image formation portions are air-cooled sequentially from the image formation portion closest to the fixing unit.

Here, preferably, the blower unit is formed with an intake fan and a discharge fan, and outside air sucked by the intake fan into a body of the apparatus is fed to the image formation portion closest to the fixing unit. Preferably, the discharge fan is also provided close to the image formation portion farthest from the fixing unit. Preferably, the discharge fan is further provided on a back side with respect to a center in a depth direction of the body of the apparatus.

In order for the image formation portions to be effectively cooled, outside air is preferably fed to a back side of the image formation portion closest to the fixing unit, a drive source being provided on the back side.

Alternatively, an exposure device that exposes the uniformly charged surface of the electrostatic latent image carrying member to form the latent image on the electrostatic latent image carrying member is provided below the image formation portions and an intake fan is provided on a side surface of the exposure device far from the fixing unit, and a ventilation path is formed on a side surface of the exposure device on the back side, and the outside air sucked by the intake fan into a body of the apparatus is fed through the ventilation path to the back side of the image formation portion closest to the fixing unit.

Here, alternatively, a division plate in which a slit opening for acquiring an optical path of light applied from the exposure device to the electrostatic latent image carrying member of each of the image formation portions is formed is provided between the exposure device and the image formation portions, and the air flows through a space between the division plate and the image formation portions toward a discharge fan.

Furthermore, alternatively, an exposure device that exposes the uniformly charged surface of the electrostatic latent image carrying member to form the latent image on the electrostatic latent image carrying member is provided below the image formation portions, the intake fan is provided on a side surface of the exposure device far from the fixing unit, a division plate in which a slit opening for acquiring an optical path of light applied from the exposure device to the electrostatic latent image carrying member of each of the image formation portions is formed is provided between the exposure device and the image formation portions and a seal member is provided between the exposure device and the division plate such that the seal member surrounds the slit openings other than the slit opening corresponding to the electrostatic latent image carrying member of the image formation portion closest to the fixing unit, and outside air sucked by the intake fan into the body of the apparatus is fed through the slit opening corresponding to the electrostatic latent image carrying member of the image formation portion closest to the fixing unit to a space between the division plate and the image formation portions.

Here, the air may flow through the space between the division plate and the image formation portions toward the discharge fan.

Furthermore, alternatively, an exposure device that exposes the uniformly charged surface of the electrostatic latent image carrying member to form the latent image on the electrostatic latent image carrying member is provided below the image formation portions, the intake fan is provided on a side surface of the exposure device far from the fixing unit, a first ventilation path leading from the intake fan through near a heating portion of the exposure device to the image formation portion closest to the fixing unit and a second ventilation path leading from the intake fan directly to the image formation portion closest from the fixing unit are formed and outside air sucked by the intake fan into the body of the apparatus is fed through the first ventilation path and the second ventilation path to the image formation portion closest to the fixing unit.

DESCRIPTION OF PREFERRED EMBODIMENTS

Although an image forming apparatus according to the present invention is described with reference to accompanying drawings, the present invention is not limited to these embodiments.

Figure 1:
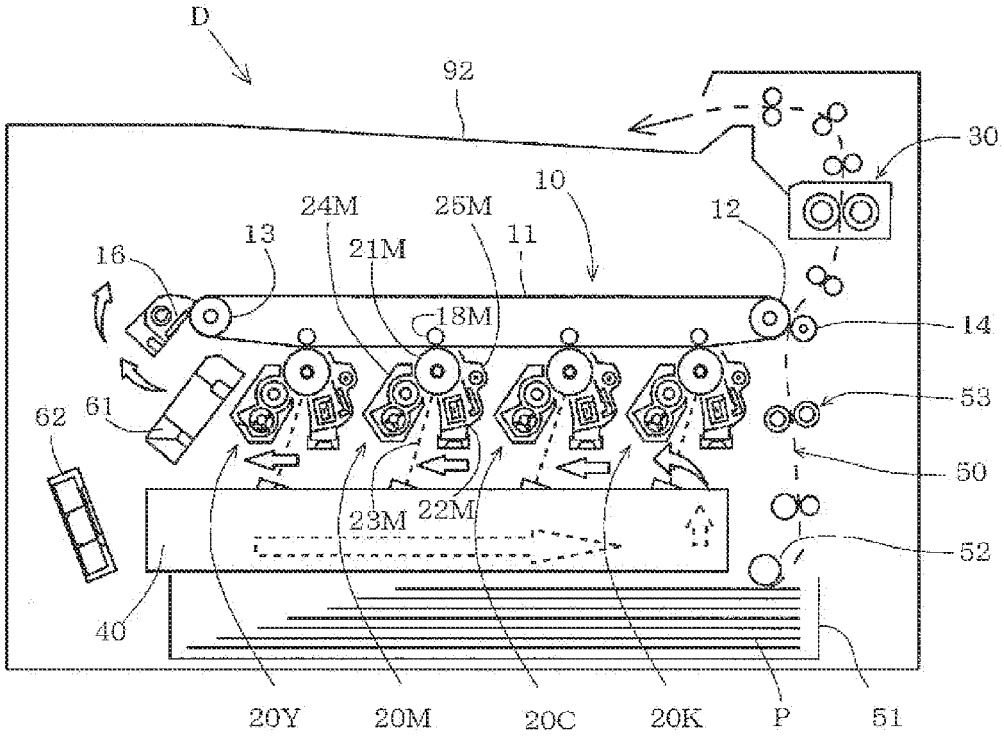
FIG. 1 A schematic diagram showing an embodiment of an image forming apparatus according to the present invention.

FIG. 1 is a schematic diagram showing an embodiment of the image forming apparatus according to the present invention. The image forming apparatus shown in this figure is a so-called tandem color printer. Naturally, the present invention can be applied to a printer, a copying machine incorporating a scanner, a facsimile, a multifunctional machine that combines those functions and the like.

An intermediate transfer unit 10 is provided substantially in the middle of the image forming apparatus D. An endless intermediate transfer belt 11 that is a main constituent element of the intermediate transfer unit 10 is strung between a roller 12 and a roller 13, and is rotated counterclockwise with an unillustrated motor. A secondary transfer roller 14 is pressed onto the roller 12 through the intermediate transfer belt 11. In a nip portion (secondary transfer region) between the secondary transfer roller 14 and the intermediate transfer belt 11, a toner image formed on the intermediate transfer belt 11 is transferred to a transfer-receiving member P that has been transported.

A cleaning blade 16 is pressed onto the roller 13 through the intermediate transfer belt 11, and collects and removes the toner on the intermediate transfer belt 11 that has not been transferred.

Below the intermediate transfer belt 11, four image formation portions 20Y, 20M, 20C and 20K of yellow (Y), magenta (M), cyan (C) and black (K) (hereinafter also referred to as the "image formation portion 20") are arranged in this order from the upstream side in the direction of rotation of the intermediate transfer belt 11. These image formation portions 20 use the developers of the individual colors to form toner images of the corresponding colors. Although, in FIG. 1, symbols are given to only the constituent elements of the image formation portion 20M of magenta (M), since the other image formation portions 20Y, 20C and 20K have the same configuration, each constituent element will be described below without color representing symbols being given.

The image formation portion 20 has a rotatable photoconductor drum (electrostatic latent image carrying member) 21. Around the image formation portion 20, a charging unit 22, an optical path 23 from an exposure device 40, which will be described later, a development unit 24, a primary transfer roller 18 and a photoconductor cleaning member 25 are arranged in this order along the direction of rotation (clockwise direction). The front side of the plane of the figure is the side where a user performs an operation; on the rear side of the plane of the figure (the back side of the apparatus), drive sources for the image formation portions 20 and the like and a drive transmission mechanism are provided.

The photoconductor drum 21 of the image formation portion 20 and the primary transfer roller 18 are pressed onto each other through the intermediate transfer belt 11, and form a nip portion (primary transfer region). At the nip portion, the toner image formed on the photoconductor drum 21 is transferred to the intermediate transfer belt 11, and is thereafter transferred to the transfer-receiving member as described above.

The exposure device 40 is provided below the image formation portions 20. Light emitted from the exposure device 40 travels through the optical path 23 and is applied to each of the photoconductor drums 21, and the electrostatic latent images corresponding to the individual colors are formed on the individual photoconductor drums 21. As will be described later, the exposure device 40 includes not only optical components such as a lens and a mirror but also a heating portion 41 (see FIG. 10) such as a laser element or a polygon mirror.

Below the exposure device 40, a paper feed cassette 51 is arranged such that the paper feed cassette 51 is removable with respect to the body of the apparatus. The transfer-receiving members P are stacked and held in the paper feed cassette 51. By the rotation of a paper feed roller 52 arranged in an upper side portion of the paper feed cassette 51, the transfer-receiving members P are sequentially fed out to a transport path 50 one by one from the uppermost one. The transfer-receiving member P fed out of the paper feed cassette 51 is transported to a resist roller pair 53, where the transfer-receiving member P is fed out to the secondary transfer region in synchronization with the rotation of the intermediate transfer belt 11.

An example of the image formation operation will be briefly described. In each of the image formation portions 20, the surface of the photoconductor drum 21 rotated and driven at a predetermined circumferential speed is uniformly charged by the charging unit 22. Then, light corresponding to image information is applied from the exposure device 40 to the charged surface of the photoconductor drum 21, and thus the electrostatic latent image is formed on the surface of the photoconductor drum 21. Then, the electrostatic latent image is visualized by the toner supplied from the development unit 24. When the toner images of the individual colors formed on the surface of the photoconductor drum 21 in this way reach the primary transfer region by the rotation of the photoconductor drum 21, they are transferred (primarily transferred) to the intermediate transfer belt 11 from yellow to magenta to cyan and then to black in this order and are superimposed on each other.

The toner that has been left on the photoconductor drum 21 without being transferred to the intermediate transfer belt 11 is scraped by the photoconductor cleaning member 25 and is removed from the surface of the photoconductor drum 21.

The superimposed toner images of the four colors are transported by the intermediate transfer belt 11 to the secondary transfer region. At the same time, on the other hand, the transfer-receiving member P is transported from the resist roller pair 53 to the secondary transfer region. Then, in the secondary transfer region, the toner images of the four colors are transferred (secondarily transferred) from the intermediate transfer belt 11 to the transfer-receiving member P at a time. The transfer-receiving member P to which the toner images of the four colors have been transferred is transported to a fixing unit 30 and is passed through a nip portion between a fixing roller and a pressurizing roller. In the meantime, the transfer-receiving member P is heated and pressurized, and the toner images are melted and fixed to the transfer-receiving member P. The transfer-receiving member P in which the toner images have been fixed is ejected through an ejection port to a paper ejection tray 92.

Figure 2:
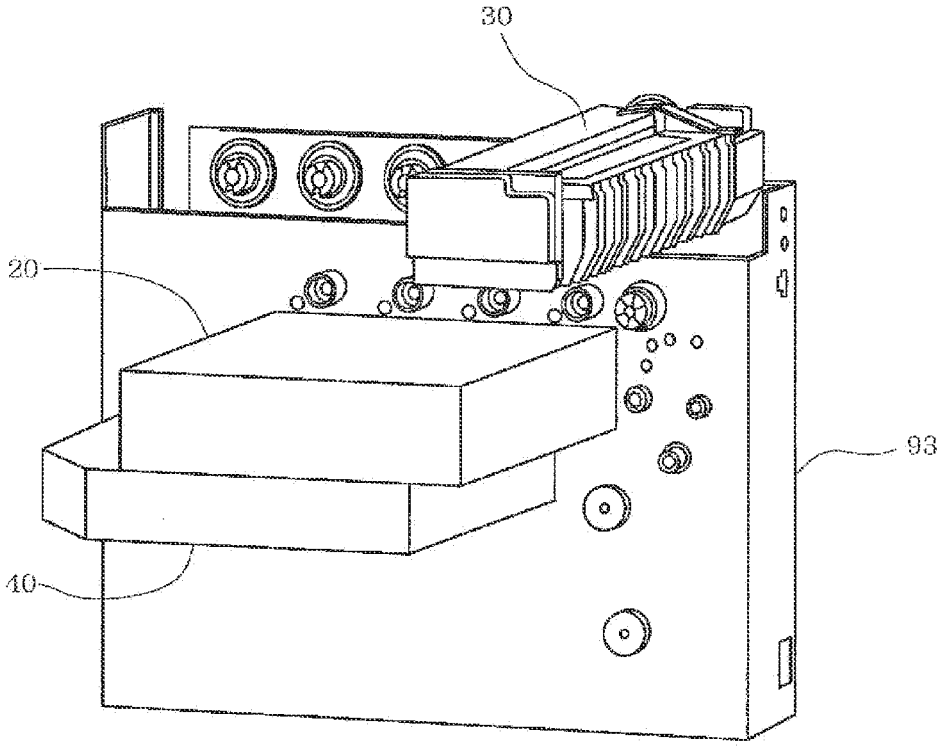
FIG. 2 A schematic perspective view showing the arrangement of a fixing unit, image formation portions and an exposure device.

In the image forming apparatus D having the structure described above, a positional relationship between the fixing unit 30, a plurality of image formation portions 20 and the exposure device 40 is shown in FIG. 2. With respect to the distance from the fixing unit 30 to each of the image formation portions 20, the image formation portion 20K is closest to the fixing unit 30, and the image formation portion 20Y is farthest from the fixing unit 30. Hence, the mage formation portion 20K is likely to be heated the most by the fixing unit 30, and the image formation portion 20Y is likely to be heated the least by the fixing unit 30. Drive forces for the rotation of the photoconductor drums 21 in the image formation portions 20 and the rotation of the agitation blade of the development unit 24 and the like are transmitted from one end on the side of a chassis 93. Furthermore, a rotational drive force for the intermediate transfer belt 11 and rotational drive forces for various transport rollers for transporting the transfer-receiving member P are also driven by power sources provided on the side of the chassis 93. A large amount of heat is produced by these power sources and a power transmission mechanism.

Figure 3:
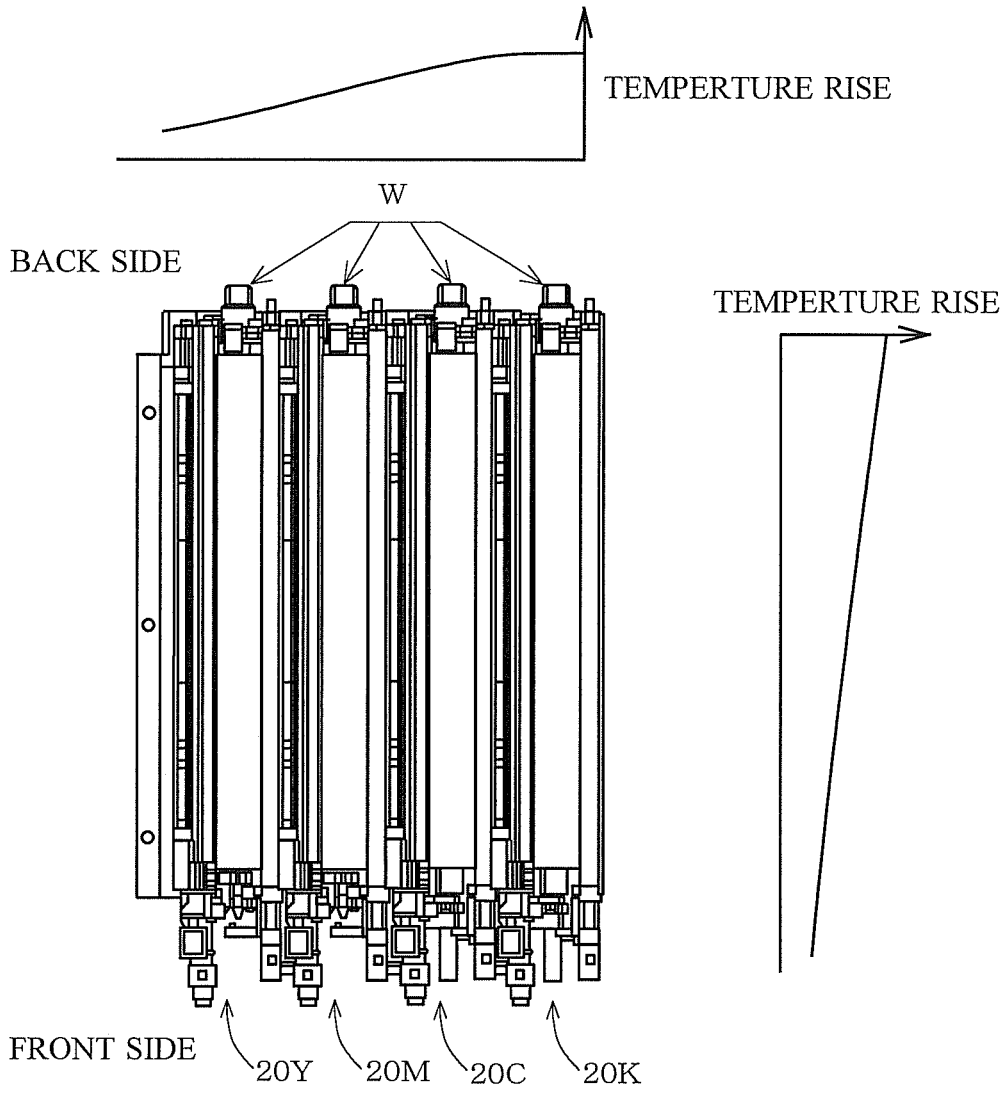
FIG. 3 A plan view illustrating the distribution of temperature of the image formation portions.

FIG. 3 is a plan view of the image formation portion 20. The fixing unit 30 is arranged on the right side of the figure; the drive source is arranged on the back side. As described above, the temperature of the image formation portion 20 closer to the fixing unit 30 is more likely to be increased; the back side close to the drive source is more likely to be increased. Hence, the temperature of the back side of the image formation portion 20K is likely to be increased the most, and the temperature of the front side of the image formation portion 20Y is likely to be increased the least.

For this reason, in the image forming apparatus according to the present invention, an airflow is formed from the image formation portion 20K closest to the fixing unit to the image formation portion 20Y farthest from the fixing unit, and a plurality of image formation portions are air-cooled sequentially from the image formation portion 20K closest to the fixing unit.

Figure 4:
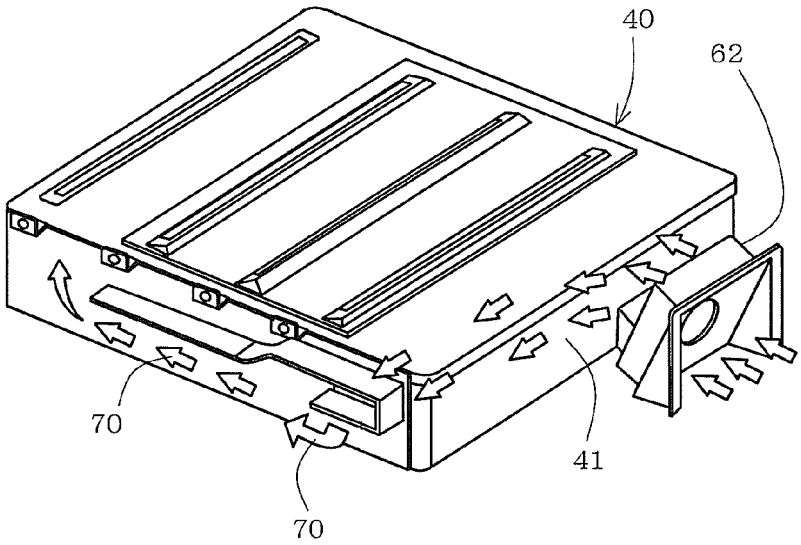
FIG. 4 A perspective view illustrating an airflow path formed on a side surface of the exposure device on a back side.

In FIG. 1, an intake fan (blower unit) 62 is provided on the side of the side surface of the exposure device 40 far from the fixing unit 30, and a discharge fan (blower unit) 61 is provided on the left side of the image formation portion 20Y farthest from the fixing unit 30. As shown in FIG. 4, on the side surface of the exposure device on the back side, a ventilation path 70 leading from the intake fan 62 to the back surface of the image formation portion 20K closest to the fixing unit 30.

Outside air sucked by the intake fan 62 is fed to the back surface of the image formation portion 20K through the ventilation path 70 on the side surface of the exposure device 40. Then, by suction of the outside air by the discharge fan 61, the outside air flows on the upper surface of the exposure device 40 from the image formation portion 20K to the image formation portion 20Y. Thus, the image formation portions 20 are air-cooled sequentially from the image formation portion 20K, whose temperature is likely to be increased the most. Simultaneously, the air fed from the intake fan 62 is passed along the back surface and the left side surface of the exposure device 40, and thus it is possible to air-cool the heating portion 41 (see FIG. 10) of the exposure device 40 such as a laser output portion and a polygon minor drive portion.

Figure 5:
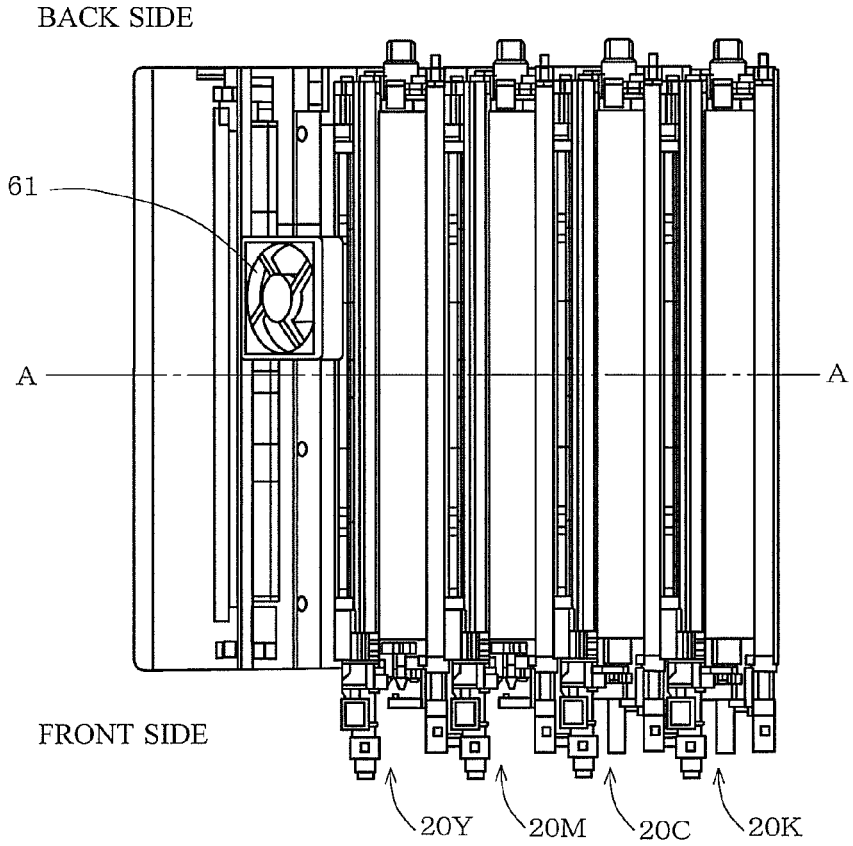
FIG. 5 A plan view of the image formation portions showing a position of attachment of a discharge fan.

Here, it is suggested that, as shown in FIG. 5, the discharge fan 61 should be attached at a position on the back side with respect to the center (represented by line A-A in the figure) in the direction of the rotational shaft of the image formation portion 20. In this way, a larger amount of airflow moving from the image formation portion 20K to the image formation portion 20Y flows on the back side than in the center in the direction of the rotational shaft, and thus it is possible to effectively air-cool the back side of the image formation portions 20, whose temperatures are more likely to be increased.

Figure 6:
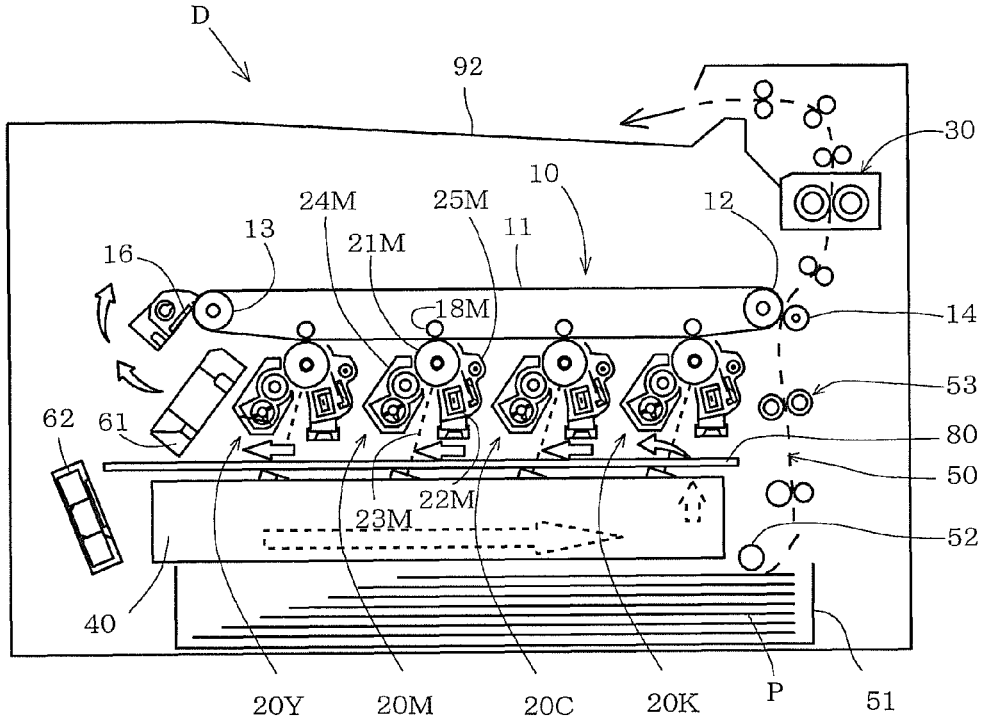
FIG. 6 A schematic diagram showing another embodiment of the image forming apparatus according to the present invention.
Figure 7:
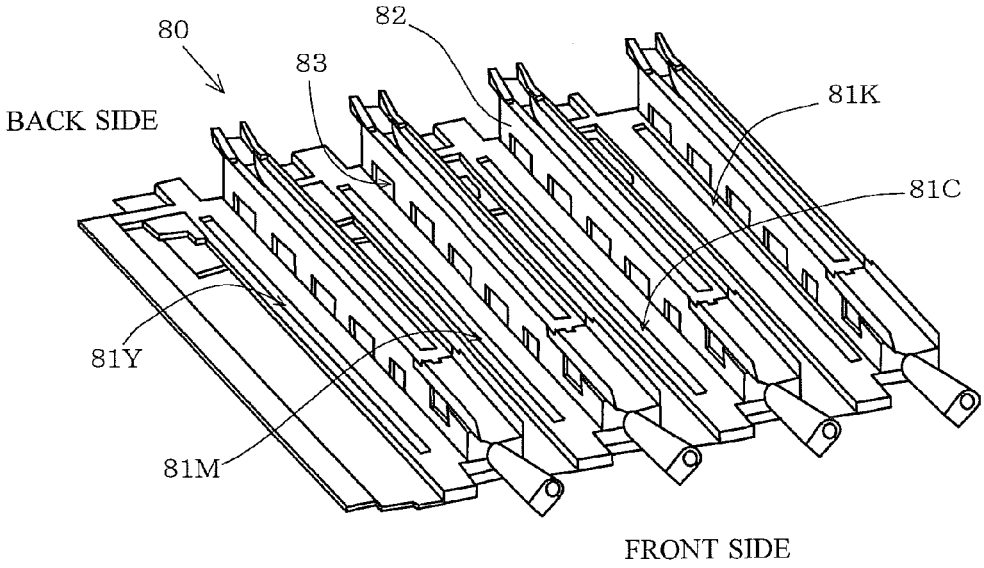
FIG. 7 A perspective view of a division plate.

FIG. 6 shows another embodiment of the image forming apparatus according to the present invention. In the image forming apparatus shown in this figure, a division plate 80 is provided between the image formation portions 20 and the exposure device 40. As shown in FIG. 7, slit openings 81Y, 81M, 81C and 81K are formed in the division plate 80 at positions corresponding to the image formation portions 20 of the individual colors so that the optical paths 23 of the light emitted from the exposure device 40 are not blocked. Moreover, in the division plate 80, guide stages 82 for attaching and detaching the individual image formation portions 20 to and from the body of the apparatus are formed such that the guide stages 82 correspond to the individual image formation portions 20. Since, as will be described later, the air flows along the surface of the division plate 80, a plurality of ventilation paths 83 are formed across the guide stages 82 such that the guide stages 82 are prevented from blocking the airflow.

As shown in FIG. 6, the outside air sucked by the intake fan 62 into the body of the apparatus is passed along the ventilation path 70 (see FIG. 4), and is fed from the back side of the image formation portion 20K to the upper surface of the division plate 80. Then, by suction of the air by the discharge fan 61, the air flows through the space between the division plate 80 and the image formation portions 20 from the image formation portion 20K to the image formation portion 20Y. In this way, the image formation portions 20 are air-cooled sequentially from the image formation portion 20K, whose temperature is likely to be increased the most.

Figure 8:
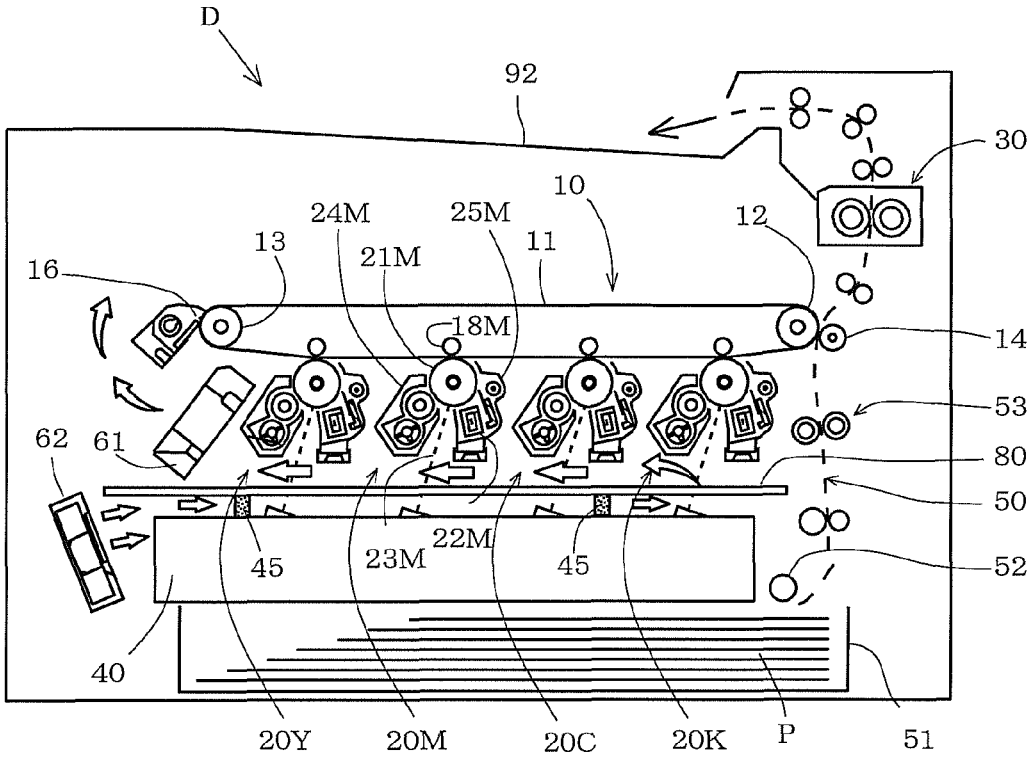
FIG. 8 A schematic diagram showing yet another embodiment of the image forming apparatus according to the present invention.
Figure 9:
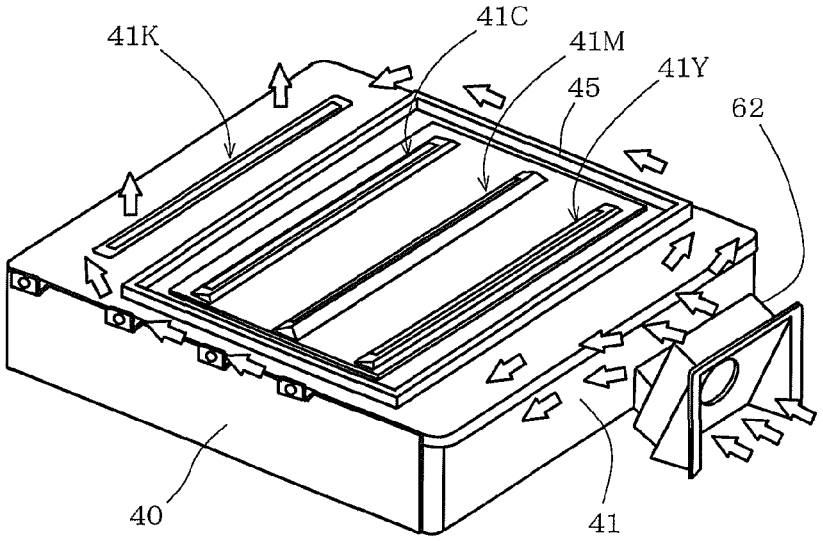
FIG. 9 A perspective view showing the flow of air supplied from an intake fan around the exposure device.

FIG. 8 shows yet another embodiment of the image forming apparatus according to the present invention. The image forming apparatus shown in this figure is the same as that shown in FIG. 6 in that the division plate 80 is provided between the image formation portions 20 and the exposure device 40 but differs in that the outside air sucked by the intake fan 62 flows not along the side surface of the exposure device 40 but mainly along the upper surface of the exposure device 40 and then flows upward through the slit opening 81K of the division plate 80. Specifically, as shown in FIG. 9, in the upper surface of the exposure device 40, emission windows 41Y, 41M, 41C and 41K for emitting the light to the image formation portions 20 of the individual colors are formed. An elastic protruding seal member 45 is provided to surround the emission windows 41Y, 41M and 41C.

When the exposure device 40 and the division plate 80 are attached to the body of the apparatus, the exposure device 40 and the division plate 80 are opposite each other a predetermined space apart. Then, the seal member 45 makes contact with the division plate 80, and the emission windows 41M, 41C and 41K are sealed by the seal member 45. When, in this state, the intake fan 62 is driven, the outside air sucked by the intake fan 62 into the body of the apparatus is passed around the perimeter of the seal member 45 (see FIG. 9), and is fed upward through the slit opening 81K of the division plate 80. Then, by suction of the air by the discharge fan 61, the air flows through the space between the division plate 80 and the image formation portions 20 from the image formation portion 20K to the image formation portion 20Y. In this way, the image formation portions 20 are air-cooled sequentially from the image formation portion 20K, whose temperature is likely to be increased the most.

Figure 10:
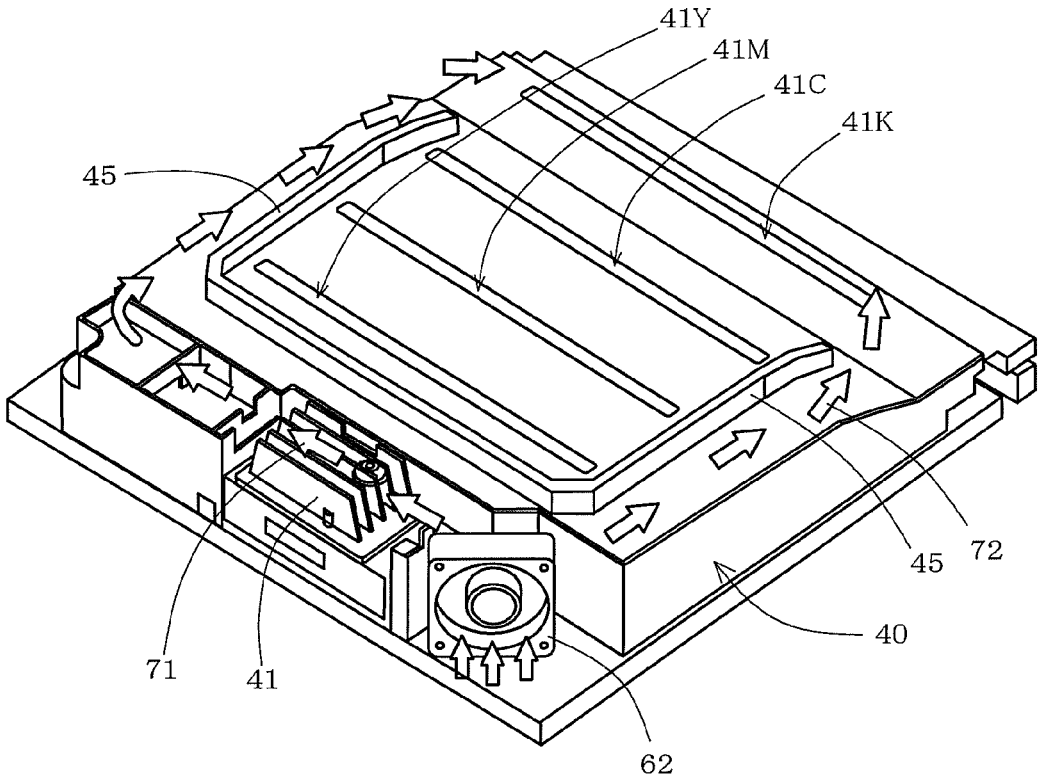
FIG. 10 A perspective view of the exposure device showing another embodiment of the image forming apparatus according to the present invention.

FIG. 10 shows yet another embodiment of the image forming apparatus according to the present invention. The image forming apparatus shown in this figure is the same as that shown in FIG. 8 in that the seal member 45 is provided between the exposure device 40 and the division plate 80 to surround the emission windows 41M, 41C and 41K and that the outside air sucked by the intake fan 62 into the body of the apparatus is passed around the perimeter of the seal member 45 and is fed upward through the slit opening 81K (see FIG. 7) of the division plate 80, but differs in that the intake fan 62 is attached at a position on the front side of the side surface far from the fixing unit 30.

Since the intake fan 62 is provided on the front side of the side surface far from the fixing unit 30, the flow path of the air fed from the intake fan 62 is divided into a first ventilation path 71 leading through the heating portion 41 of the exposure device 40 to the slit opening 81K of the division plate 80 and a second ventilation path 72 leading directly to the slit opening 81K of the division plate 80. Thus, it is possible to cool both the image formation portions 20 and the exposure device 40.

Although, in all the embodiments described above, the discharge fan 61 and the intake fan 62 are used as the blower units, only any one of them may be used. Another fan other than the two fans described above may be provided.

What is claimed is:

1. An image forming apparatus comprising:

a plurality of image formation portions that include: a rotatable electrostatic latent image carrying member; a charging unit which uniformly charges a surface of the electrostatic latent image carrying member; and a development unit which visualizes, with toner, an latent image formed on the electrostatic latent image carrying member and that forms toner images of different colors;

a transfer unit that transfers the toner images formed and superimposed by the image formation portions to a transfer-receiving member;

a fixing unit that heats the transferred toner images to melt and fix the toner images to the transfer-receiving member; and a blower system that forms an airflow moving from an image formation portion closest to the fixing unit to an image formation portion farthest from the fixing unit, wherein the image formation portions are air-cooled sequentially from the image formation portion closest to the fixing unit, and wherein the blower system is formed with an intake fan and a discharge fan, and outside air sucked by the intake fan into a body of the apparatus is fed to the image formation portion closest to the fixing unit.

2. The image forming apparatus of claim 1, wherein the discharge fan is provided close to the image formation portion farthest from the fixing unit.

3. The image forming apparatus of claim 1, wherein the discharge fan is provided on a back side with respect to a center in a depth direction of the body of the apparatus.

4. An image forming apparatus comprising:

a plurality of image formation portions that include: a rotatable electrostatic latent image carrying member; a charging unit which uniformly charges a surface of the electrostatic latent image carrying member; and a development unit which visualizes, with toner, an latent image formed on the electrostatic latent image carrying member and that forms toner images of different colors;

a transfer unit that transfers the toner images formed and superimposed by the image formation portions to a transfer-receiving member;

a fixing unit that heats the transferred toner images to melt and fix the toner images to the transfer-receiving member; and a blower system that forms an airflow moving from an image formation portion closest to the fixing unit to an image formation portion farthest from the fixing unit, wherein the image formation portions are air-cooled sequentially from the image formation portion closest to the fixing unit, and wherein outside air is fed to a back side of the image formation portion closest to the fixing unit, a drive source being provided on the back side.

5. The image forming apparatus of claim 4, wherein an exposure device that exposes the uniformly charged surface of the electrostatic latent image carrying member to form the latent image on the electrostatic latent image carrying member is provided below the image formation portions and an intake fan is provided on a side surface of the exposure device far from the fixing unit, and a ventilation path is formed on a side surface of the exposure device on the back side, and the outside air sucked by the intake fan into a body of the apparatus is fed through the ventilation path to the back side of the image formation portion closest to the fixing unit.

6. The image forming apparatus of claim 5, wherein a division plate in which a slit opening for acquiring an optical path of light applied from the exposure device to the electrostatic latent image carrying member of each of the image formation portions is formed is provided between the exposure device and the image formation portions, and the air flows through a space between the division plate and the image formation portions toward a discharge fan.

7. The image forming apparatus of claim 1, wherein an exposure device that exposes the uniformly charged surface of the electrostatic latent image carrying member to form the latent image on the electrostatic latent image carrying member is provided below the image formation portions, the intake fan is provided on a side surface of the exposure device far from the fixing unit, a division plate in which a slit opening for acquiring an optical path of light applied from the exposure device to the electrostatic latent image carrying member of each of the image formation portions is formed is provided between the exposure device and the image formation portions and a seal member is provided between the exposure device and the division plate such that the seal member surrounds the slit openings other than the slit opening corresponding to the electrostatic latent image carrying member of the image formation portion closest to the fixing unit, and outside air sucked by the intake fan into the body of the apparatus is fed through the slit opening corresponding to the electrostatic latent image carrying member of the image formation portion closest to the fixing unit to a space between the division plate and the image formation portions.

8. The image forming apparatus of claim 7, wherein the air flows through the space between the division plate and the image formation portions toward the discharge fan.

9. The image forming apparatus of claim 1, wherein an exposure device that exposes the uniformly charged surface of the electrostatic latent image carrying member to form the latent image on the electrostatic latent image carrying member is provided below the image formation portions, the intake fan is provided on a side surface of the exposure device far from the fixing unit, a first ventilation path leading from the intake fan through near a heating portion of the exposure device to the image formation portion closest to the fixing unit and a second ventilation path leading from the intake fan directly to the image formation portion closest from the fixing unit are formed and outside air sucked by the intake fan into the body of the apparatus is fed through the first ventilation path and the second ventilation path to the image formation portion closest to the fixing unit.

* * * * *